US011891267B2

(12) United States Patent
Roa-Quispe et al.

(10) Patent No.: US 11,891,267 B2
(45) Date of Patent: Feb. 6, 2024

(54) STACKABLE SPOOL CABLE MANAGER

(71) Applicant: Belden Canada ULC, Saint-Laurent (CA)

(72) Inventors: Christian Roa-Quispe, Laval (CA); Oscar Alberto Lazarte Barrios, Montreal (CA)

(73) Assignee: BELDEN CANADA ULC, Saint-Laurent (CA)

( * ) Notice: Subject to any disclaimer, the term of this patent is extended or adjusted under 35 U.S.C. 154(b) by 0 days.

(21) Appl. No.: 17/545,626

(22) Filed: Dec. 8, 2021

(65) Prior Publication Data

US 2022/0177259 A1 Jun. 9, 2022

Related U.S. Application Data

(60) Provisional application No. 63/122,552, filed on Dec. 8, 2020.

(51) Int. Cl.
*B65H 75/22* (2006.01)
*B65H 75/24* (2006.01)

(52) U.S. Cl.
CPC ..... *B65H 75/2272* (2021.05); *B65H 75/24* (2013.01); *B65H 2402/10* (2013.01)

(58) Field of Classification Search
None
See application file for complete search history.

(56) References Cited

U.S. PATENT DOCUMENTS

| | | | | | |
|---|---|---|---|---|---|
| 5,724,469 | A * | 3/1998 | Orlando | G02B 6/444 | 385/135 |
| 5,727,752 | A * | 3/1998 | Matsuzoe | B65H 75/22 | 242/608.6 |
| 5,803,401 | A * | 9/1998 | Matsuzoe | B65H 75/22 | 242/608.5 |
| 6,481,662 | B1 * | 11/2002 | Kles | B65H 54/58 | 242/400.1 |
| 6,612,515 | B1 * | 9/2003 | Tinucci | B65H 75/143 | 242/612 |
| 6,814,328 | B1 * | 11/2004 | Li | G02B 6/4457 | 242/400.1 |
| 7,684,670 | B2 * | 3/2010 | Tsutsumi | G02B 6/4457 | 439/19 |
| 8,750,668 | B2 * | 6/2014 | Chu | G02B 6/4457 | 385/135 |
| 8,831,394 | B2 * | 9/2014 | Kimbrell | B65H 75/36 | 385/137 |
| 9,274,301 | B2 * | 3/2016 | Her | G02B 6/4471 | |
| 9,581,783 | B2 * | 2/2017 | Gilbreath | F16L 3/06 | |
| 9,678,299 | B2 * | 6/2017 | Wells | B65H 75/08 | |
| 10,928,602 | B2 * | 2/2021 | Haile-Mariam | G02B 6/3897 | |
| 11,320,616 | B2 * | 5/2022 | Al Ghossein | G02B 6/4478 | |

(Continued)

*Primary Examiner* — William A. Rivera
(74) *Attorney, Agent, or Firm* — LAVERY, DE BILLY, LLP; Hugh Mansfield

(57) ABSTRACT

A stackable spool cable manager assembly is disclosed which comprises a plurality of like cable manager spools. The cable manager spools comprise a locking mechanism such that the cable manager spools can be stacked and such that when locked together a cable support arm of each the cable manager spools is offset from the others. A magnet is also provided, for example for securing to a bottom ne of a stack of cable manager spools such that they can be secured to a metal tray or the like.

21 Claims, 7 Drawing Sheets

(56) References Cited

U.S. PATENT DOCUMENTS

| | | | | |
|---|---|---|---|---|
| 2013/0200193 | A1* | 8/2013 | Lichoulas | G02B 6/4457<br>242/118.3 |
| 2014/0027558 | A1* | 1/2014 | Kawauchi | B65H 49/328<br>242/571 |

* cited by examiner

STACKABLE SPOOL CABLE MANAGER

CROSS REFERENCE TO RELATED APPLICATIONS

This application claims benefit, under 35 U.S.C. § 119(e) of U.S. provisional application Ser. No. 63/122,552 filed on Dec. 8, 2020 and which is incorporated herein in its entirety by reference.

FIELD OF THE INVENTION

The present invention relates to a stackable spool cable manager.

BACKGROUND TO THE INVENTION

The present invention relates to a stackable spool cable manager.

SUMMARY OF THE INVENTION

There is provided a stackable spool cable manager assembly for mounting on a surface manufactured from a ferrous material. The assembly comprises a plurality of like cable manager spools, each of the cable manager spools comprising a center portion comprising an outer surface, a top surface and a bottom surface opposite the top surface and a locking mechanism comprising a first part on the top surface and a second part in a bottom surface, a support arm extending away from the center portion and comprising a cable support surface and an end stop attached to an outer end of the cable support surface, and a magnet, wherein the first part is configured to engage with the second part and such that an upper one of the plurality of cable manager spools is engageable with an adjacent lower one of the plurality of cable manager spools, wherein the support arm of each of the cable manager spools is positioned such that on securing of the lower cable manager spools to the upper cable manager spools, a support arm of the lower cable manager spools is offset from a support arm of the upper cable manager spool, and wherein the magnet is positioned in a bottom one of the plurality of cable manager spools and such that when positioned on the tray, the magnet secures the plurality of like cable manager spools to the tray.

There is also provided a cable manager spool, comprising a center portion comprising a cylindrical outer surface, a flat top surface and a flat bottom surface in parallel to the top surface, a locking mechanism comprising a first part on the top surface and a second part in a bottom surface and an orifice in the bottom surface, a support arm extending radially away from the center portion and comprising a flat cable support surface wherein an underside of the flat cable support surface lies substantially in the same plane as the bottom surface, and further comprising an end stop, a lower long edge of the end stop attached to an outer end of the cable support surface and such that the planar end stop is at a right angle to the cable support surface and at least one flat finger extending away from an upper long edge of the end stop towards the center portion and such that a flat under side of the at least one finger is coplanar and in parallel to the cable support surface, and a magnet dimensioned to fit within the orifice.

DETAILED DESCRIPTION OF THE ILLUSTRATIVE EMBODIMENTS

Figure 1:
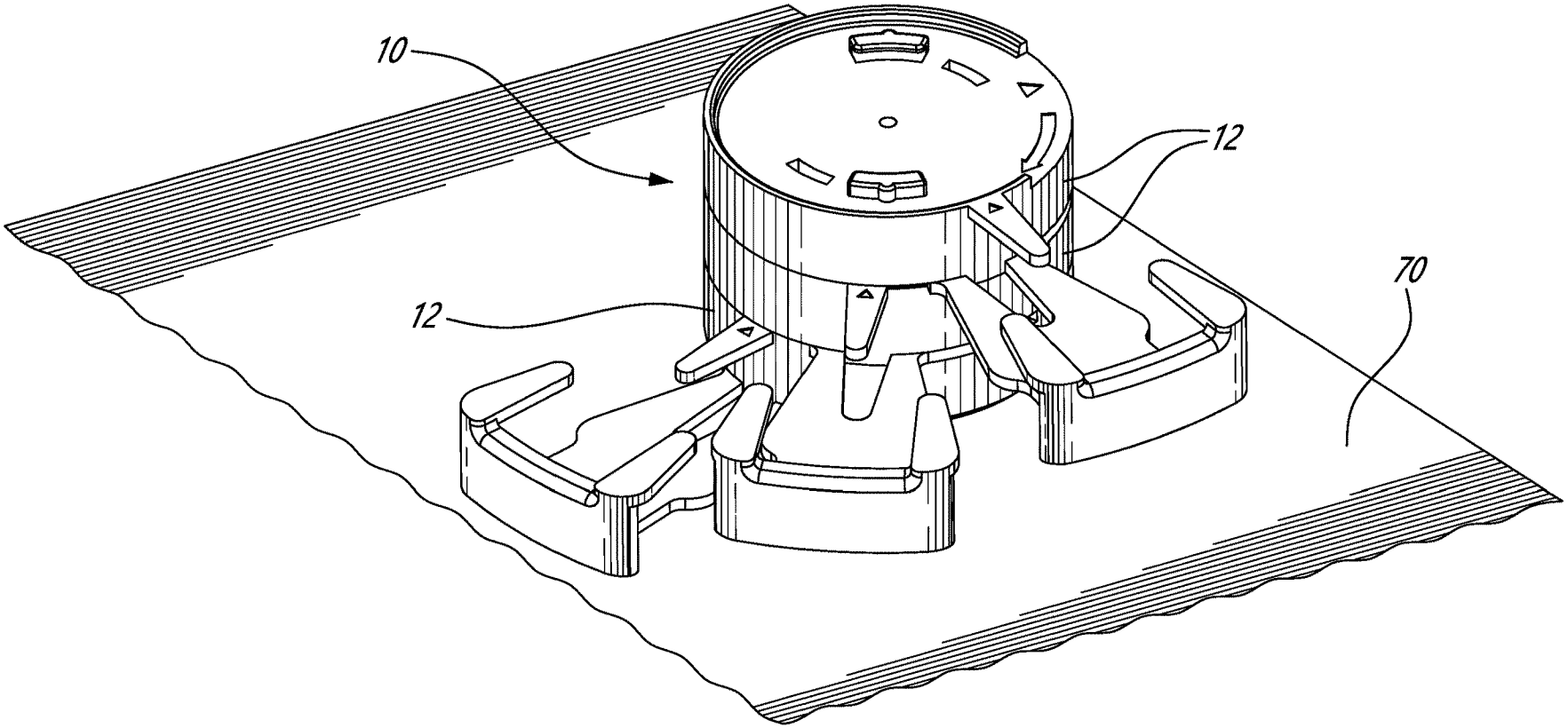
FIG. 1 provides a raised perspective view of cable spool manager assembly on a tray in accordance with an illustrative embodiment of the present invention.

Referring now to FIG. 1, a stackable spool cable manager assembly, generally referred to using the reference numeral 10, will now be described. The manager assembly 10 comprises a plurality of like cable spool managers 12 which are stacked on one another to form the manager assembly 10.

Figure 2:
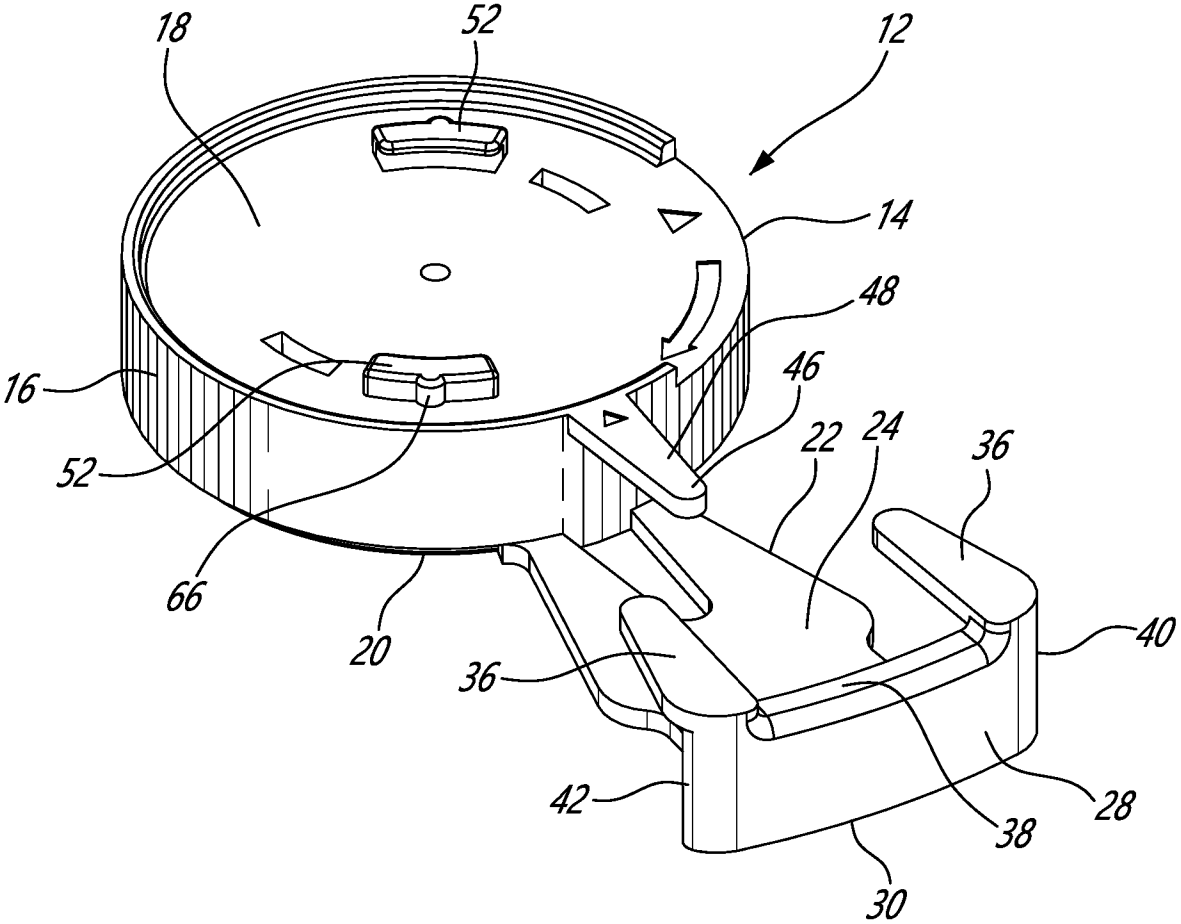
FIG. 2 provides a raised perspective view of cable spool manager in accordance with an illustrative embodiment of the present invention.
Figure 3:
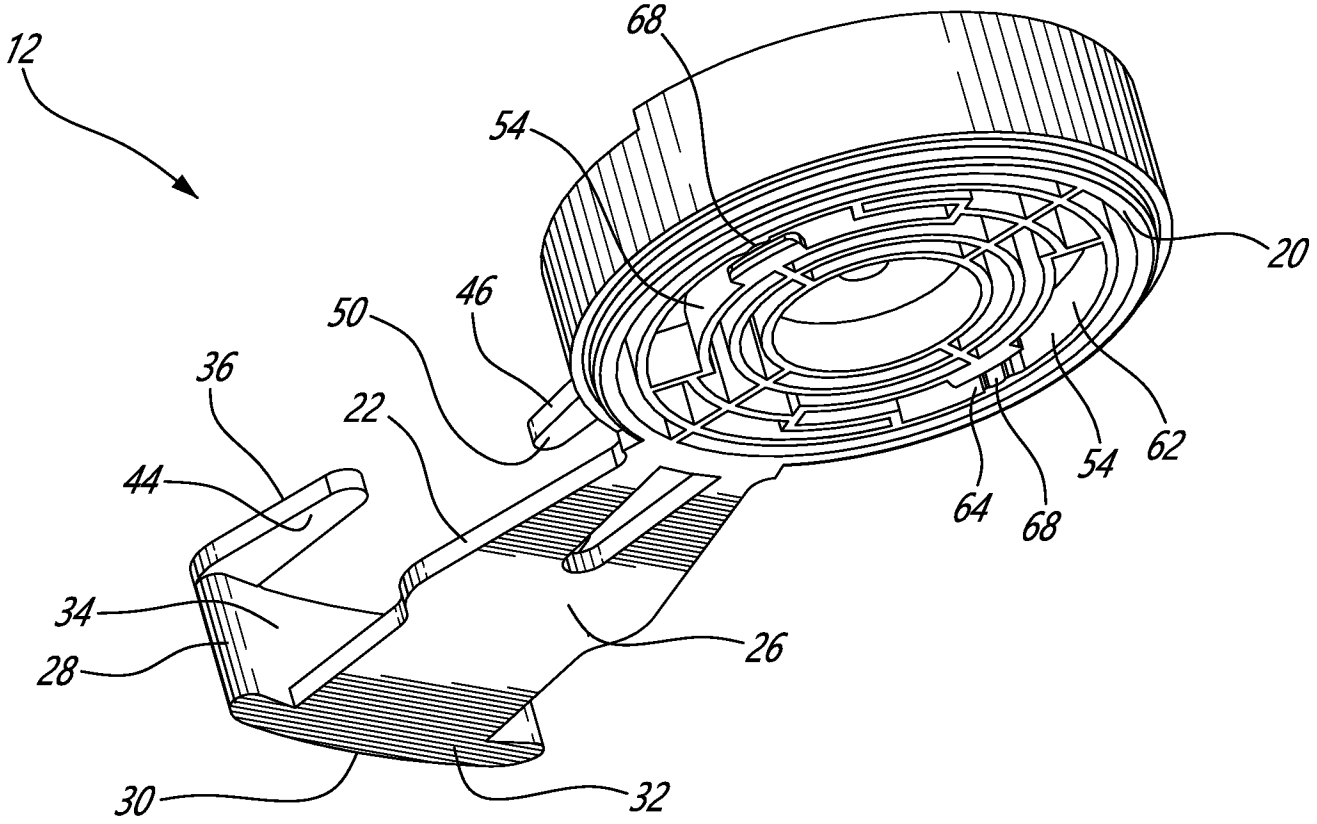
FIG. 3 provides a lowered perspective view of cable spool manager in accordance with an illustrative embodiment of the present invention.

Referring to FIG. 2 and FIG. 3, each cable spool manager 12 comprises a center portion 14 comprising a cylindrical outer surface 16, a flat top surface 18 and a flat bottom surface 20 arranged in parallel to the top surface 18. A support arm 22 extends radially outward from the cylindrical outer surface 16 and comprises a flat cable support surface 24. An underside 26 of the cable support surface 24 lies substantially in the same plane as the bottom surface 20. An elongate end stop 28 is attached along a lower long edge 30 to an outer end 32 of the cable support surface 24 and such that a curved surface 34 of the end stop 28 is arranged at right angles to the cable support surface 24. Additionally, a center of radius of curvature of the curved surface 34 of the end stop 28 is concentric with a radius of curvature of the center portion 14.

Still referring to FIG. 2 and FIG. 3, a pair of elongate fingers 36 extend away from an upper long edge 38 of the end stop 28 towards the center portion 154. Each finger 36 is positioned towards a respective end 40, 42 of the end stop 28. A flat underside 44 of each of the fingers 36 is flat and coplanar, and the underside 44 arranged in parallel to the flat cable support surface 24. A third substantially flat finger 46 is provided extending from the center portion 14 and aligned radially with the flat cable support surface 24. An upper surface 48 of the third finger 46 lies in substantially the same plane as the top surface 18 and an underside 50 of the third finger 46 lies opposite and in parallel to the flat cable support surface 24 and in the same plane as the underside 44 of each of the pair of fingers 36. The flat cable support surface 24, the undersides 44 of the pair of fingers 36 and the underside 50 of the third finger 46 together define a cable receiving region.

Still referring to FIG. 2 and FIG. 3, the center portion 14 further comprises a locking mechanism comprising a plurality of L-shaped tabs 52 extending from the top surface 18 and a corresponding plurality of tab receiving slots 54 molded or otherwise formed in the bottom surface 20.

Figure 4A:
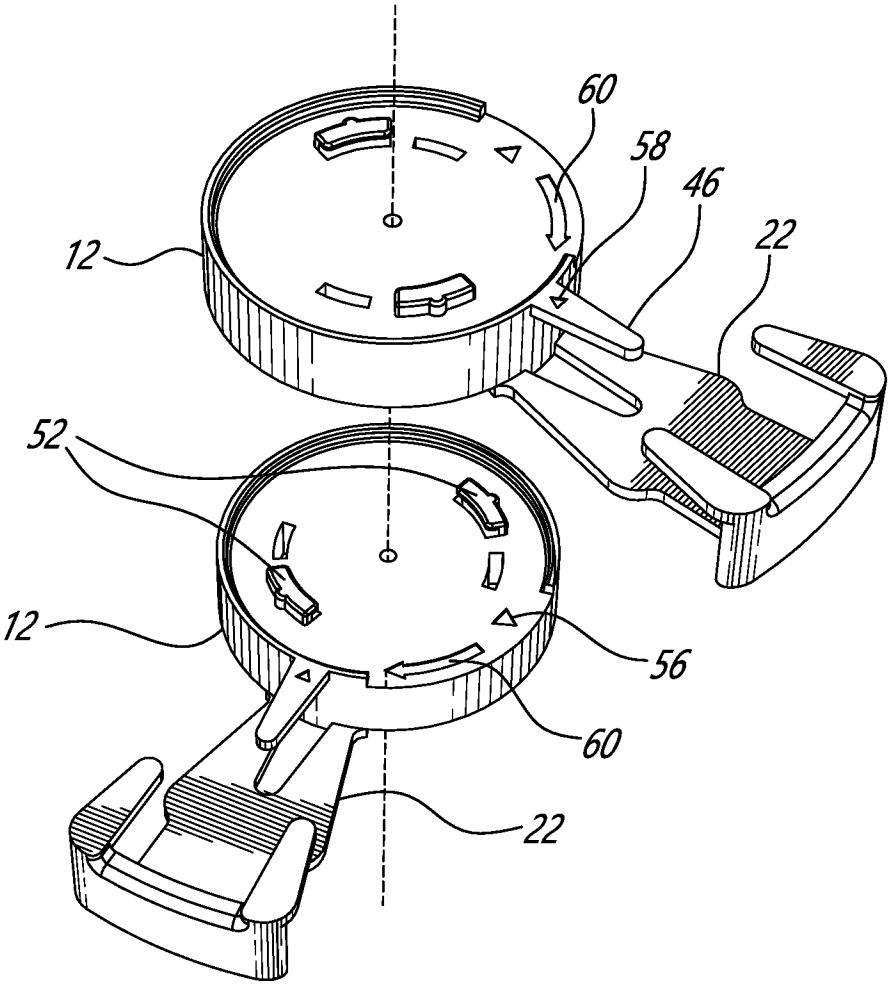
FIG. 4A provides a raised perspective view of a pair of disassembled cable spool managers in accordance with an illustrative embodiment of the present invention.

Referring now to FIG. 4A in addition to FIG. 3, in order to assemble the like cable spool managers 12 to form an assembly 10, a lower one of the cable spool managers 12 is concentrically aligned with an upper one of the cable spool managers 12 and such that a guide arrow 56 of the lower one of the cable spool managers 12 is aligned with a guide arrow 58 on the third finger 46 of the upper one of the cable spool managers 12 and such that their respective support arms 22 are arranged substantially at right angles. In this orientation the L-shaped tabs 52 of the lower one of the cable spool managers 12 are aligned with respective ones of the plurality of tab receiving slots 54.

Figure 4B:
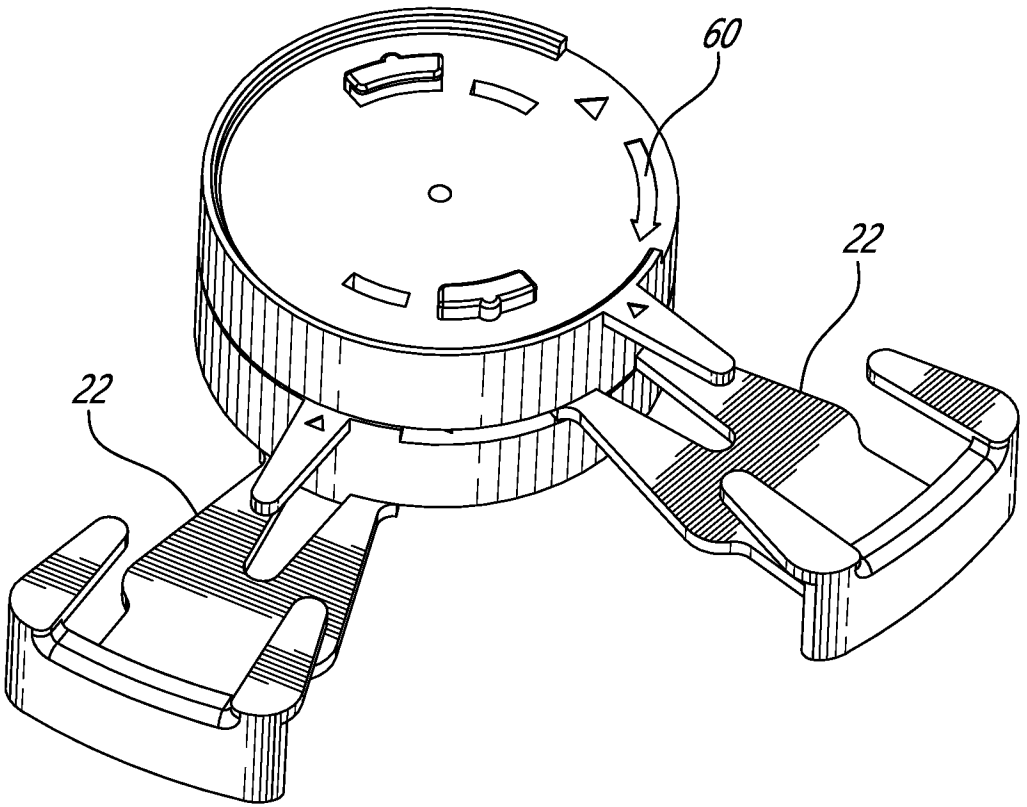
FIG. 4B provides a raised perspective view of a pair of partially assembled cable spool managers in accordance with an illustrative embodiment of the present invention.

With reference now to FIG. 4B in addition to FIG. 3 and FIG. 4A, the L-shaped tabs 52 of the lower one of the cable spool managers 12 are then inserted into their respective tab receiving slots 54 and the lower cable spool manager 12 rotated relative to the upper cable spool manager 12 and in accordance with the direction indicated by an assembly arrow 60. In this regard, each of the tab receiving slots 54 comprises a wider slot part 62 and a narrower slot part 64.

Figure 4C:
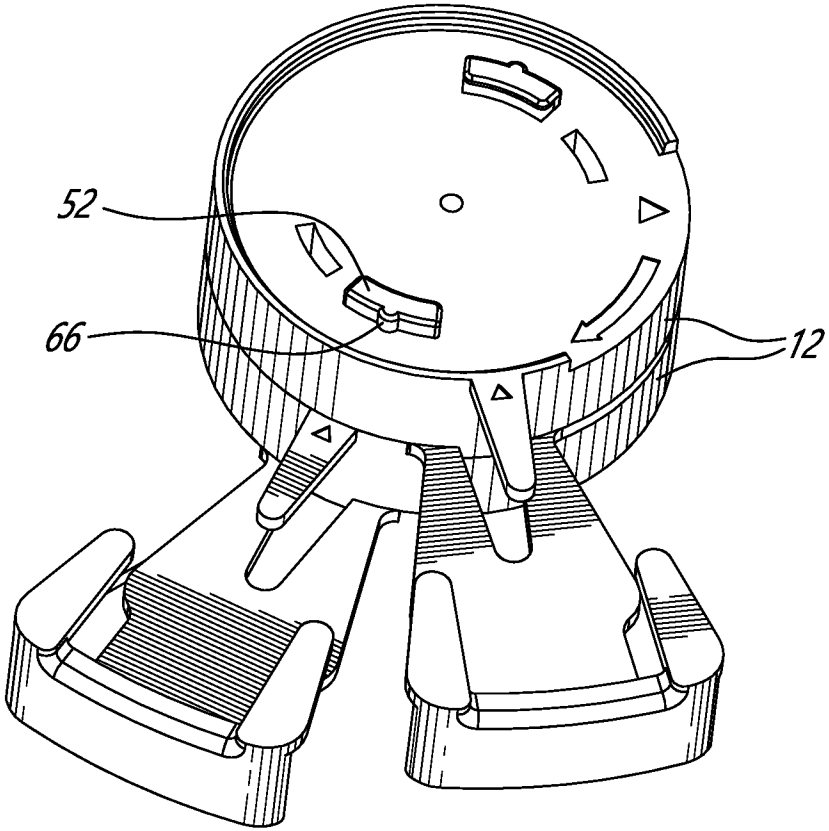
FIG. 4C provides a raised perspective view of a pair of assembled cable spool managers in accordance with an illustrative embodiment of the present invention.

As shown in FIG. 4C, as the lower cable spool manager 12 is rotated relative to the upper cable spool manager 12 each of the L shaped tabs 52 moves from the wider slot part 62 to the narrower slot part 64 and such that the bottom surface 20 of the upper cable management spool is gripped by each of said L-shaped tabs 52. With reference back to FIG. 3 in addition to FIG. 4C, as the lower cable spool manager 12 is rotated relative to the upper cable spool manager 12 into the assemble position, a boss 66 on each of L shaped tabs 52 is engaged by complementary features 68 adjacent each narrower slot part 64 and such that the lower cable spool manager 12 is releasably secured to the upper cable spool manager 12 in the assembled position.

Figure 5:
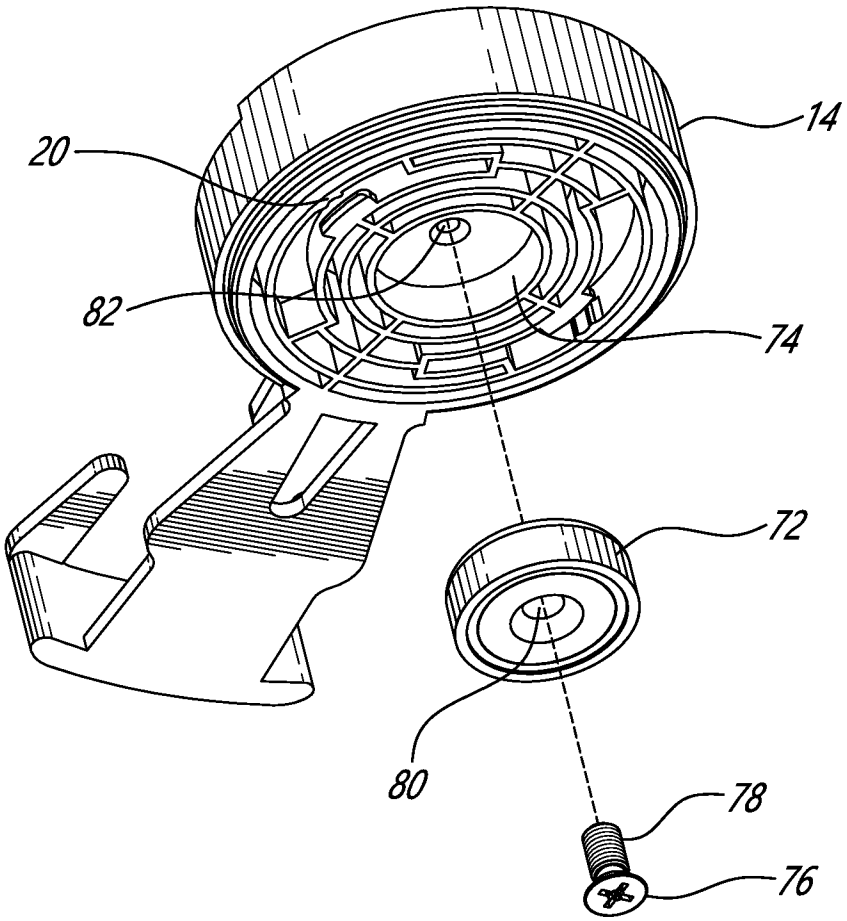
FIG. 5 provides an exploded lowered perspective view of cable spool manager and magnet in accordance with an illustrative embodiment of the present invention.

Referring now to FIG. 5 in addition to FIG. 1, in order to secure the stackable spool cable manager assembly 10 to a tray 70 or the like manufactured from a ferrous material, a disk-shaped magnet 72 may be secured to the bottom surface 20. In this regard, an annular magnet receiving orifice 74 is provided concentric with the center portion 14. The magnet 72 is illustratively secured within the orifice 74 using a bolt 76, a threaded end 78 of which is inserted through a bore 80 in the magnet 72 and engaged in a complementary threaded bore 82 in the center portion 14.

Although the present invention has been described hereinabove by way of specific embodiments thereof, it can be modified, without departing from the spirit and nature of the subject invention as defined in the appended claims.

The invention claimed is:

1. A stackable spool cable manager assembly for mounting on a surface manufactured from a ferrous material, comprising:

a plurality of like cable manager spools, each of the cable manager spools comprising:

a center portion comprising an outer surface, a top surface and a bottom surface opposite the top surface and a locking mechanism comprising a first part on the top surface and a second part in a bottom surface;

a support arm extending away from the center portion and comprising a cable support surface and an end stop attached to an outer end of the cable support surface;

a magnet;

wherein the center portion comprises a cylindrical outer surface, a flat top surface and a flat bottom surface in parallel to the top surface;

wherein the first part comprises a plurality of L shaped tabs extending from the too surface and spaced along a first path concentric with the cylindrical outer surface;

wherein the second part comprises a plurality of tab receiving slots in the bottom surface and spaced along a second path concentric with the cylindrical outer surface and in parallel to the first path;

wherein a lower one of the cable manager spools is secured to an adjacent upper one of the cable manager spools by inserting each of the L shaped labs of the lower cable manager spool into a respective one of the tab receiving slots of the upper cable manager spool and rotating the lower cable manager spool relative to the upper cable manager spool and such that each of the L shaped tabs of the lower cable manager spool is received into a respective one of the tab receiving slots of the upper cable manager spool and the bottom surface of the upper cable management spool is gripped by each of the L-shaped tabs;

wherein the support arm of each of the cable manager spools is positioned such that on securing of the lower cable manager spools to the upper cable manager spools, a support arm of the lower cable manager spools is offset from a support arm of the upper cable manager spool; and wherein the magnet is positioned in a bottom of a bottom one of the plurality of cable manager spools and such that when positioned on the surface manufactured from the ferrous material, the magnet secures the plurality of like cable manager spools to the surface manufactured from the ferrous material.

2. The stackable spool cable manager assembly of claim 1, wherein each of the tab receiving slots comprises a wider slot part and a narrower slot part the wider slot part dimensioned for receiving an inserted one of the L shaped tabs and further wherein a lower one of the cable manager spools is secured to an adjacent upper one of the cable manager spools by inserting each of the tabs of the lower cable manager spool into a respective one of the wider slot parts of the upper cable management spool and rotating the lower cable manager spool relative to the upper cable manager spool and such that each of the L shaped tabs of the lower cable manager spool is received into a respective narrower slot part of the upper cable manager spool and bottom surface of upper cable management spool is gripped by each of L-shaped tabs.

3. The stackable spool cable manager assembly of claim 1, further comprising an orifice in bottom surface for receiving the magnet.

4. The stackable spool cable manager assembly of claim 1, further comprising an orifice in the bottom surface for receiving the magnet and wherein orifice is concentric with the cylindrical outer surface.

5. The stackable spool cable manager assembly of claim 4, wherein the magnet is disk shaped and further wherein the orifice is annular.

6. The stackable spool cable manager assembly of claim 1, wherein the support arm extends radially away from the center portion.

7. The stackable spool cable manager assembly of claim 1, wherein an underside of the flat cable support surface lies substantially in the same plane as the bottom surface, and further comprising an elongate planar end stop, a lower long edge of the end stop attached to an outer end of the cable support surface and such that the planar end stop is at a right angle to the cable support surface.

8. The stackable spool cable manager assembly of claim 7, wherein the elongate planar end stop is curved and further wherein a radius of curvature of the curved end stop is concentric with the said center portion.

9. The stackable spool cable manager assembly of claim 8, further comprising a pair of like flat fingers extending away from an upper long edge of the end stop towards the center portion and such that a flat under side of each of the fingers is coplanar and in parallel to the cable support surface, each of the fingers positioned towards a respective end of the end stop.

10. The stackable spool cable manager assembly of claim 1, further comprising a third substantially flat finger extending from the center portion and aligned radially with the flat cable support surface.

11. The stackable spool cable manager assembly of claim 10, wherein an upper surface of the third flat finger lies in the same plane as flat top surface and an underside of the third flat finger is positioned opposite and in parallel to the cable support surface.

12. A cable manager spool, comprising:

a center portion comprising a cylindrical outer surface, a flat top surface and a flat bottom surface in parallel to the top surface, a locking mechanism comprising a first part on the top surface and a second part in the bottom surface, and an orifice in the bottom surface;

a support arm extending radially away from the center portion and comprising a flat cable support surface wherein an underside of the flat cable support surface lies substantially in the same plane as the bottom surface, and further comprising an end stop, a lower long edge of the end stop attached to an outer end of the cable support surface and such that the planar end stop is at a right angle to the cable support surface and at least one flat finger extending away from an upper long edge end stop towards the center portion and such that a flat under side of the at least one finger is coplanar and in parallel to the cable support surface; and a magnet dimensioned to fit within the orifice.

13. The cable manager spool of claim 12, wherein the first comprises wherein the first part comprises a plurality of L shaped tabs extending from the top surface and spaced along a first path concentric with the cylindrical outer surface and a corresponding plurality of tab receiving slots in the bottom surface and spaced along a second path concentric with the cylindrical outer surface and in parallel to the first path and such that when the cable manager spool is secured to a like cable manager spool the support arm is offset from a the like cable manager spool.

14. The cable manager spool of claim 13, wherein the cable manager spool is secured to the like cable manager spool by inserting each of the L shaped tabs into respective tab receiving slots of the like cable manager spool and rotating the cable manager spool relative to the like cable manager spool and such that each of the L shaped tabs of the cable manager spool is received into a respective one of the tab receiving slots of the like cable manager spool and a bottom surface of the like cable manager spool is gripped by each of the L-shaped tabs.

15. The cable manager spool of claim 14, wherein each of the tab receiving slots comprises a wider slot part and a narrower slot part, the wider slot part dimensioned for receiving an inserted one of the L shaped tabs and further wherein the cable manager spool is secured to the like cable manager spool by inserting each of the tabs into a respective wider slot parts of the like cable manager spool and rotating the manager spool relative to the like cable manager spool such that each of the L shaped tabs is received into a respective narrower slot part of the like cable manager spool and a bottom surface of the like cable manager spool is gripped by each of the L-shaped tabs.

16. The cable manager spool of claim 12, wherein the magnet is disk-shaped and the orifice is annular and concentric with the cylindrical outer surface.

17. The cable manager spool of claim 12, wherein the planar end stop is curved and wherein a center of radius of curvature of the end stop is concentric with the center portion.

18. The cable manager spool of claim 12, further comprising a third substantially flat finger extending from the center portion and aligned radially with the flat cable support surface, wherein an upper surface of the third flat finger lies substantially in the same plane as t flat top surface.

19. A stackable spool cable manager assembly, comprising:

a plurality of like cable manager spools, each of the cable manager spools comprising:

a center portion comprising a cylindrical outer surface, a top surface, a bottom surface opposite the top surface, a plurality of L shaped tabs extending from the top surface and spaced along a first path concentric with the cylindrical outer surface and a plurality of tab receiving slots in the bottom surface and spaced along a second path concentric with the cylindrical outer surface and in parallel to the first path;

a support arm extending away from the center portion and comprising a cable support surface and an end stop attached to an outer end of the cable support surface;

wherein a lower one of the cable manager spools is secured to an adjacent upper one of the cable manager spools by inserting each of the L shaped tabs of the lower cable manager spool into a respective one of the tab receiving slots of the upper cable manager spool and rotating the lower cable manager spool relative to the upper cable manager spool and such that each of the L shaped tabs of the lower cable manager spool is received into a respective one of the tab receiving slots of the upper cable manager spool and the bottom surface of the upper cable management spool is gripped by each of the L-shaped tabs.

20. The cable manager assembly of claim 19, wherein the support arm of each of the cable manager spools is positioned such that when a lower cable manager spool is secured to an upper cable manager spool, a support arm of the lower cable manager spool is offset from a support arm of the upper cable manager spool.

21. The cable manager assembly of claim 19, wherein the assembly is for mounting to a tray manufactured from a ferrous material and wherein the assembly further comprises a magnet positioned in a bottom of a bottom one of the plurality of cable manager spools and such that when positioned on the tray, the magnet secures the plurality of like cable manager spools to the tray.

* * * * *